US007471213B2

(12) United States Patent
Ellison

(10) Patent No.: US 7,471,213 B2
(45) Date of Patent: Dec. 30, 2008

(54) EMERGENCY RESPONSE WARNING SYSTEM

(76) Inventor: Aaron K. Ellison, 19312 Bentler, Detroit, MI (US) 48219

( * ) Notice: Subject to any disclaimer, the term of this patent is extended or adjusted under 35 U.S.C. 154(b) by 62 days.

(21) Appl. No.: 11/173,353

(22) Filed: Jul. 1, 2005

(65) Prior Publication Data

US 2007/0001872 A1 Jan. 4, 2007

(51) Int. Cl.
*G08G 1/095* (2006.01)

(52) U.S. Cl. ..... 340/907; 340/915

(58) Field of Classification Search ..... 340/915, 340/908, 944, 471, 473, 615; 40/612
See application file for complete search history.

(56) References Cited

U.S. PATENT DOCUMENTS 6,986,597 B2 * 1/2006 Elwell ..... 362/496
2001/0054970 A1 * 12/2001 Jones ..... 340/915
2003/0185005 A1 * 10/2003 Sommers et al. ..... 362/240

* cited by examiner

*Primary Examiner*—George A Bugg
*Assistant Examiner*—Shirley Lu
(74) *Attorney, Agent, or Firm*—Brooks Kushman P.C.

(57) ABSTRACT

An emergency response warning system comprising a safety device implemented into a novel traffic signal device (10) and roadway/street light (12) structures. The emergency signal lights, (30) and (31) on the traffic signal (10) and (33) on the roadway light (12) will flash pronouncedly when a signal is received from an approaching emergency vehicle. Once the signal is received, all the emergency warning lights began to flash, this will alert drivers to move to the right and stop on roadways, and bring traffic to a stop at the intersection. Both structures are solar power during the day and battery operated a night for the best efficiency possible.

17 Claims, 3 Drawing Sheets

EMERGENCY RESPONSE WARNING SYSTEM

BACKGROUND OF THE INVENTION

1. Field of Invention

This invention relates to traffic signals and road way lights that includes an emergency safety system.

2. Objects and Advantages

This invention relates to traffic signals and road way lights, that includes a safety device, designed to enhance the communication to motorist that an emergency vehicle is approaching in a way that is clearly understood, allowing motorist to steer clear and stop, wherein the emergency vehicle to safely pass through.

Traffic signals have been around since the early 1900s and not a whole lot has change since then.

Today, there are the standard red, yellow, and green signals that all licenses drivers understands, for directing traffic flow through an intersection. The traditional shape of these signals are of a round shape, and usually in vertical format, sometimes in a horizontal form, and they all have the same common frame. These can sometimes become difficult to see in direct sunlight which color of light is illuminated during peak hours of the day, and depending on how and what direction the signal is facing.

All emergency vehicles, such as the police, fire engines, and ambulances have sirens, multiple flashing lights to alert other motorist that they must rapidly move down the road way and proceed through the intersection regardless of the present signal condition. These methods are effective at times, when motorist are alert, but not effective enough to cut down on the amount of collisions between emergency vehicles and motorist. The reasons do vary from inattentive drivers, loud noises, and newer vehicles that are well insulated from outside noises.

There have been an assortment of devices and systems offered to remedy the problem. However, offerings of prior art have there own shortcomings as well, such as U.S. Pat. No. 6,850,169, by Payam Manavi and Keyvan, T. Diba filed May 16, 2003, has message boards, chevrons and arrows that can be confusing and not distinctive enough until you have already approached the signal to understand what it says. Problems with other prior art comprising arrows to show from which direction, an emergency vehicle is approaching, this is ineffective in the event of a police chase, do to the fact that police vehicles can approach that intersection, from all directions, at same time.

Deficiencies in prior art, U.S. Pat. No. 6,072,407 and U.S. Pat. No. 5,014,052 comprises different devices and systems for the safe passage of emergency vehicles through an intersection, none have comprise a system including roadway lights.

All above prior art require electricity and are subject to fail in a serious storm. Many prior art hang in the air from cables suspended above the intersection that can sway and swing violently causing some to fall in a storm, causing damage.

Thus the need for improvement, for self sufficient, self supporting, low maintenance traffic signal and road way lights structures, which will overcome all prior art deficiencies.

SUMMARY OF THE PRESENT INVENTION

The present invention comprises a novel emergency response warning system implemented into a traffic signal device and a roadway light device, as powerful, pronounced flashing lights to provide visual warning to alert motorist on road ways that an emergency vehicle is approaching from behind or towards them, and for them to move to the right and stop, then at intersection using flashings warning lights along with blinking red traffic signal to bring all traffic to a stop. Thus allowing the emergency vehicles to move safely down the road way and through the intersection.

In one aspect of the main embodiment, of the present invention, is the emergency warning lights constructed to be seen from blocks away regardless of the bright sun, rain, and darkness, such that the warning lights are highly visible urging drivers to pay attention to developing circumstances. Thereby avoiding emergency vehicles that must move quickly through.

The second aspect of the present invention comprises the structures of the road way light and traffic signals where as they stand and function independently needing no cable for support.

The third aspect of the present invention such that there in no necessity for electricity needed power, there in an improvement for conserving energy, and will not falter during electricity failure.

The forth aspect of the present invention comprises larger signal lamps for improved visibility during peak sunlight hours, thus an improvement.

Figures 1, 1A, 1B:
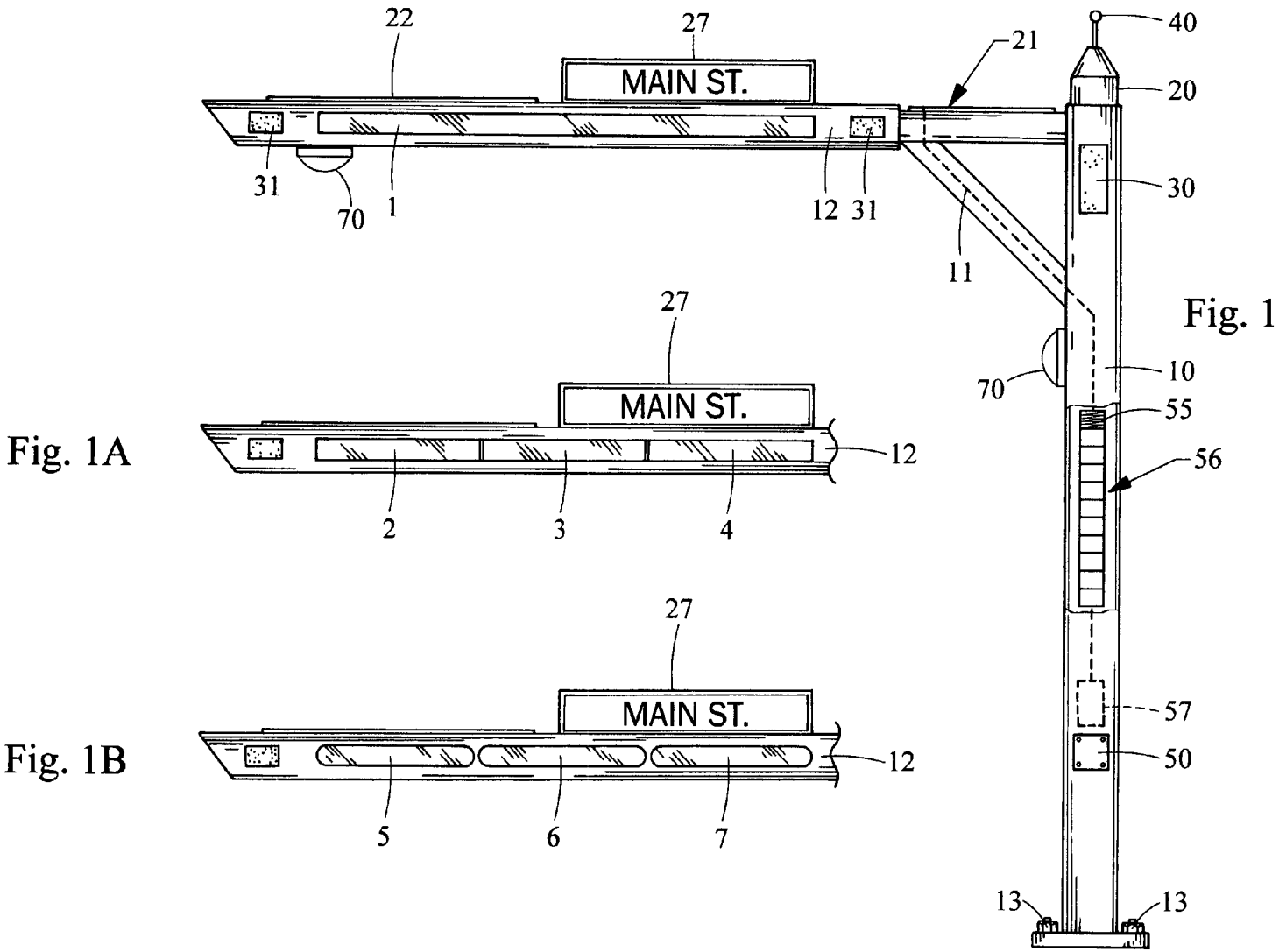
FIG. 1 shows an elevated traffic signal device comprising.

a.) an single signal lamp lens 1, having fiber optic or LED light source displaying one illuminated color at a time.

b.) a base tower support 10.

c.) a support arm 11.

d.) a top support portion 12, which extend over the road way at an intersection.

e.) a solar cap 20 that sits on top of the base tower support 10.

f ) the inside solar strip 21, that rest on top of the support arm 11.

g.) the outside solar strip 22, which sit on top of the top support portion 12.

h.) the base tower emergency response warning lamp 30.

I.) the inside emergency response warning lamp 31.

j.) the outside emergency response warning lamps 31.

k.) the antenna receiver 40.

l.) access control panel 50.

m.) the recharging power core 55.

n.) removable, stackable, and rechargeable battery cells 56.

o.) the computer processor 57, controls all the functions of the signal, including signal timer.

p.) street sign 27, high and visible.

q.) securing nuts 13, holding fastener for base support 10.

FIG. 1A shows an alternative tri panel signal lamp, comprising three rectangle panels, 2 red, 3 yellow, and 4 green, shown in horizontal configuration.

Figure 2:
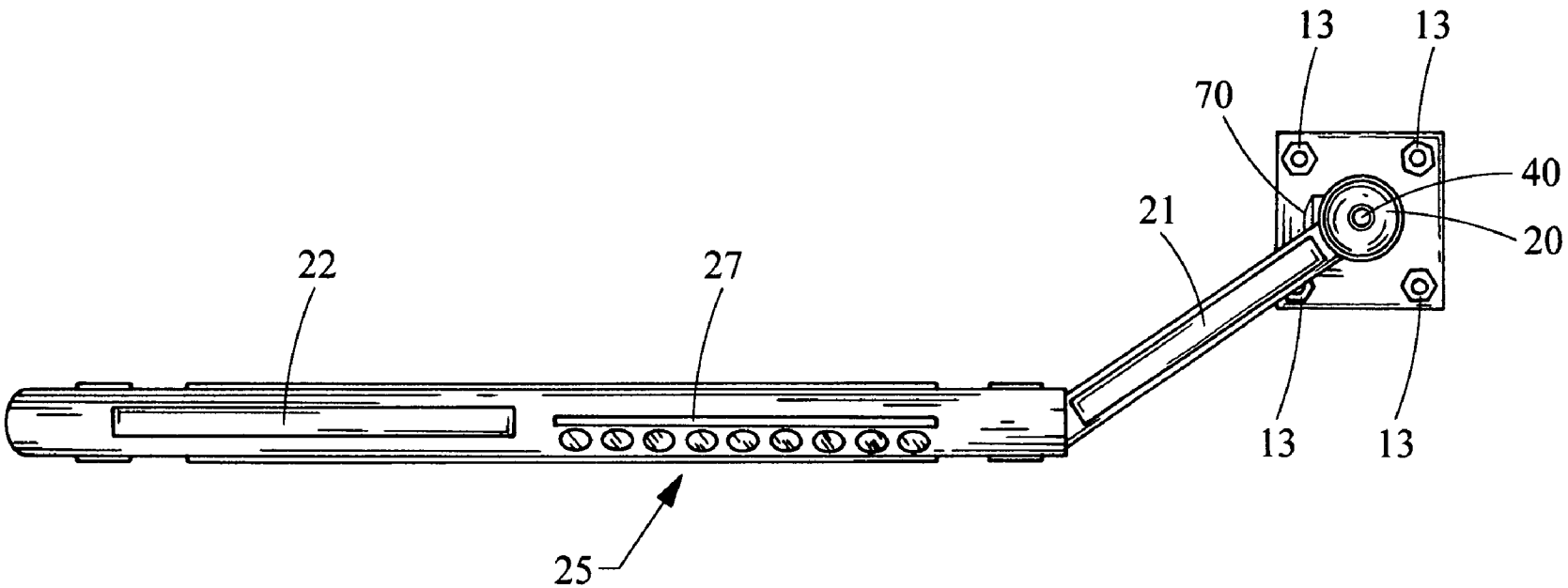

FIG. 1B show an alternative tri panel signal lamp, comprising three oblong panels, 5 red, and 6, yellow, and 7 green shown horizontally configuration FIG. 2 shows a top view of the top support portion 12 comprising;

13 securing nuts.

20 solar cap.

21 inside solar strip.

22 outside solar strip

25 lights for illuminating the street sign 27 and night.

27 street sign.

Figure 3:
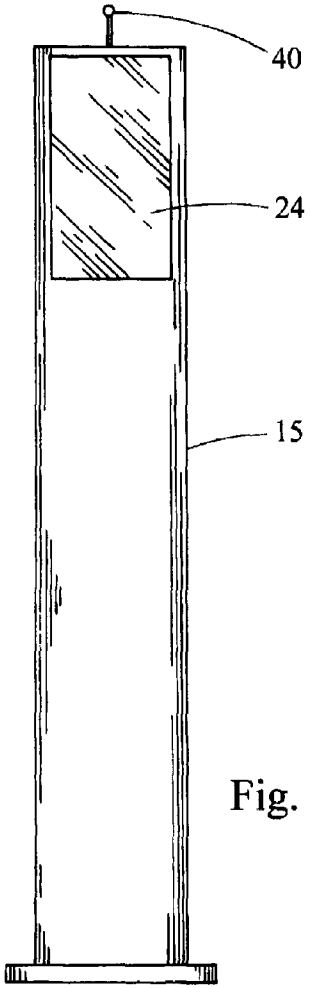

FIG. 3 shows the front elevated view of the road way light 15 comprising;

an large light lens 24, for increased brightness, and improved night visibility.

Figure 5:
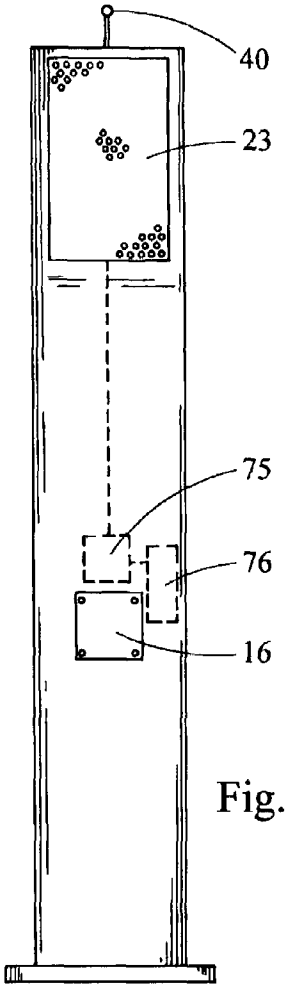
Figure 4:
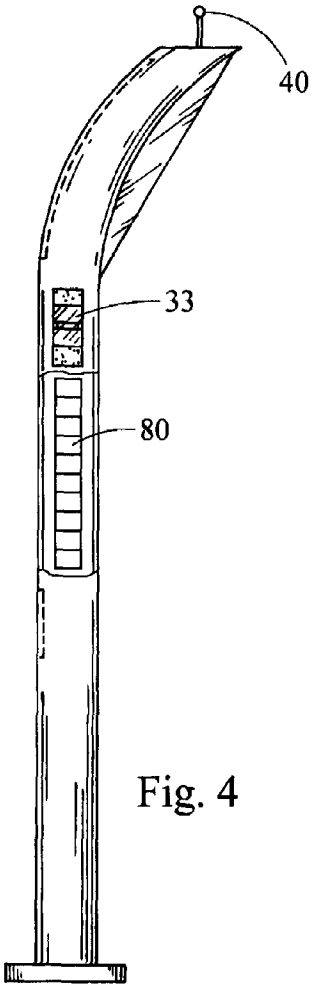

FIG. 4 shows the side elevated view of the road way light 15 comprising;

a.) a four-panel emergency response warning lights 33 shown vertically.

b.) a cut away view of the stacked batteries 80.

c.) an antenna 40 for receiving the emergency signal from emergency vehicles FIG. 5 shows the rear elevated view of the road way light 15 comprising;

a.) a large solar panel 23.

b.) an access control panel 16.

c.) battery charger 76.

d.) a computer processor 75.

e.) an antenna 40.

DETAILED DESCRIPTION OF THE DRAWINGS

FIG. 1 shows an overall view of the traffic signal device, the first embodiment of this invention, comprising an unique structure of non-traditional shape, thereby featuring a round, tubular hollow base tower, 10 that stand upright and are mounted to the ground securing with nuts 13.

As shown in FIG. 1, an top support portion 12, that extends horizontally over any road way or street, further including a signal light 1 device that is larger than any traditional round lamp, having a long rectangular shape, illuminating the entire light bar either red, yellow, or green in highly visible fiber optic or LED lighting source. An alternative signals as shown in FIG. 1A having a three rectangular shaped signal lights, 2 red, 3 yellow, and 4 green. As one is illuminated, the other two has a dark tinted appearance. An additional alternative as shown in FIG. 1B having three oblong shape signals lights, 5 being red, 6, yellow, and 7, green. As in illustration FIG. 1A, as one is illuminated, the other two has a dark tinted appearance. All signal lamps 2, 4, 4, 5, 6, and 7 can comprise either fiber optic or LED light source.

As shown in FIG. 1, the top support portion comprises emergency response warning lamps 31, along with the emergency warning lamp at the top of the base tower 30, will flash very pronouncedly once a signal is received from an emergency vehicle equipped with a special transmitter, not shown, to the antenna 40, that sits on top of the base tower 10. At an intersection, these are the lights implemented to alert the drivers to stop, whereas an emergency vehicle needs to get through quickly, without any other motorist getting in the way. No need for chevrons or arrows or message display boards as in prior art, this emergency response warning system makes no misconception about its purpose. As an emergency vehicle approaches and the warning lights flash, the signal light (FIG. 1) or signal lights (FIGS. 1A and 1B) in each direction will automatically blink red. This is a profound way to get motorist pay attention to the developing situation.

As shown in FIG. 1, a support arm 11, which acts as a support beam to help prevent the top support portion 12 from leaning over, is connected to the base tower 10, which adds to the stability of the entire signal structure. As shown in FIG. 1, the support arm 11, plays a main role for connecting many of the structure's internal wiring. As shown in FIG. 1, a solar cap 20, in conjunction with the solar strips 21 and 22, is responsible for providing power during daylight hours, and is responsible for providing the necessary power to run the power core 55, that recharges the removable and stackable batteries cells 56.

As shown in FIG. 1, a computer processor 57, controls all the vital components of the first embodiment, as such, a timer, (not shown) for controlling the signal so that it can be programmed to fulfill the obligation of that intersection, recognizing and processing the emergency signal needed to activate the emergency warning lamps 30 and 31, and the recharging cycle for the batteries cells 56.

FIG. 2 shows and top view of the first embodiment, traffic signal devices. This illustration clearly show the advantages of the embodiment with all of the solar devices 20, 21, and 22 at the top of the top support portion 12, to maximize the light source of the sun. There is a plurality of lights 25, as shown in FIG. 2, for illuminating the street sign 27, at night. Four nuts 13, secure the bottom of the base tower 10, for strong foundation, as shown in FIG. 2.

FIG. 3 shows a roadway light device 15, the second embodiment, having a large lighting lens 24, for increased brightness at night for better visibility. Having four sides, being of a flat boxed structure, that internal components can be housed inside, as such, an removable stacked battery cells 80, as shown in FIG. 4, that is recharged by the battery charger 76, as shown in FIG. 5, during daylight hours. A computer processor 75, shown in FIG. 5, can be programmed to set a timer, not shown, to monitor the recharging cycle and for recognizing an emergency signal, as shown in FIG. 4 to activate the emergency warning lights 33, alerting drivers to move to the right and stop clear of an approaching emergency vehicle.

As shown in FIG. 4, a large solar panel 23, is positioned at the top in the rear of the light structure, providing maximum exposure the sun, absorbing energy that powers the battery charger 76, shown in FIG. 5 during the daylight hours and providing the power needed to activate the emergency warning lights 33, as shown in FIG. 4. A access panel 16, shown in FIG. 5 makes for real easy access and maintenance.

The present invention has been described in respect to a specific preferred embodiment, thereof providing an improvement versus all prior art and present embodiments. Therein, it is intended that the present invention surpass all such prior art and present embodiments as fall within the scope of the appended claims.

I claim in this invention:

1. An emergency response warning system for directing roadway traffic in response to at least one approaching authorized emergency vehicle, said system comprising:

an upright base tower positioned adjacent a road, the upright base tower including at least one dedicated emergency response warning lamp facing one or more directions and operable to illuminate in response to the at least one approaching authorized emergency vehicle;

a top support affixed horizontally to the upright base tower and extending at least partially above one or more lanes in the road, the top support comprising:

at least one dedicated emergency response warning lamp facing one or more directions and operable to illuminate in response to the at least one approaching authorized emergency vehicle; and at least one traffic signal lamp embedded into the top support and directed toward oncoming traffic, the at least one traffic signal lamp having three traffic signal lights operable to illuminate in either red, yellow or green to direct traffic flow;

a street sign mounted atop the top support and arranged above the one or more lanes, the street sign having indicia indicating a name of an intersecting road proximate the emergency response warning system; and an antenna secured to the emergency response warning system and operable to receive a wireless emergency signal from the at least one approaching authorized emergency vehicle;

wherein the at least one emergency response warning lamps affixed to the upright base tower and the top support and the at least one traffic signal lamp collectively illuminate in response to the wireless emergency signal received by the antenna indicating the at least one authorized emergency vehicle is approaching, the three traffic signal lights of the at least one traffic signal lamp each being operable to illuminate red in response to the at least one approaching authorized emergency vehicle regardless of the present traffic signal cycle.

2. The emergency response warning system of claim 1, wherein the three traffic signal lights are aligned horizontally adjacent one another.

3. The emergency response warning system of claim 2, wherein the three traffic signal lights are horizontally elongated rectangular lamps.

4. The emergency response warning system of claim 2, wherein the three traffic signal lights are horizontally elongated oblong lamps.

5. The emergency response warning system of claim 2, wherein the three traffic signal lights include one of a fiber optic light source and a light emitting diode (LED) light source.

6. The emergency response warning system of claim 1 further comprising at least one solar power collecting device disposed on top of the emergency response warning system for providing power to operate the emergency response warning system during the daytime.

7. The emergency response warning system of claim 6, wherein the at least one solar power collecting device comprises at least one solar strip affixed atop the top support.

8. The emergency response warning system of claim 7, wherein the at least one solar power collecting device comprises a solar cap secured to the top of the upright base tower for providing power to operate the emergency response warning system during the daytime in conjunction with the at least one solar strip.

9. The emergency response warning system of claim 6 further comprising a plurality of battery cells coupled to the at least one dedicated emergency response warning lamp and the at least one traffic signal lamp for providing power to the emergency response warning system, the plurality of battery cells being individually stackable, removable and rechargeable.

10. The emergency response warning system of claim 9, further comprising a power core coupled to the plurality of battery cells and the at least one solar power collecting device for recharging the plurality of battery cells during the daylight hours.

11. The emergency response warning system of claim 9, further comprising a controller powered by the at least one solar power collecting device or plurality of battery cells and in communication with the antenna upon receipt of the wireless emergency signal, the controller further coupled to the at least one dedicated emergency response warning lamps and the at least one traffic signal lamp for interrupting a traffic signal cycle upon receipt of the wireless emergency signal and commanding the at least one dedicated emergency response warning lamps and the at least one traffic signal lamp to repeatedly illuminate in the color red.

12. The emergency response warning system of claim 1 further comprising at least one light disposed atop the top support for illuminating the street sign at night.

13. The emergency response warning system of claim 2, wherein the three traffic signal lights each flash a red light upon receipt of the wireless signal by the antenna.

14. A method for alerting motorists that an at least one authorized emergency vehicle is approaching, the method comprising:

providing a traffic control tower positioned adjacent a road, the traffic control tower including at least one dedicated emergency response warning lamp facing one or more directions, an at least one traffic signal lamp having three traffic signal lights affixed to a transverse arm at least partially extending above one or more lanes in the road, and a controller in communication with both the at least one dedicated emergency response warning lamp and the at least one traffic signal lamp;

receiving a wireless emergency signal from an at least one authorized emergency vehicle indicating that the at least one authorized emergency vehicle is approaching the traffic control tower, the wireless emergency signal received by an antenna disposed at the traffic control tower and in communication with the controller;

interrupting a current traffic light cycle provided by the at least one traffic signal lamp based at least in part upon receiving the wireless emergency signal;

transmitting an emergency alert signal from the controller to the at least one dedicated emergency response warning lamp and the at least one traffic signal lamp based at least in part upon receiving the wireless emergency signal; and blinking the at least one dedicated emergency response warning lamp and the three traffic signal lights such that they each illuminate repeatedly in red for alerting motorists to stop and pull to the side of the road.

15. The method of claim 14, further comprising providing a street sign mounted to the transverse arm and arranged above the one or more lanes, the street sign having indicia indicating the name of an intersecting road proximate the traffic control tower.

16. The method of claim 15, further comprising at least one light disposed atop the transverse arm and couple to the controller, wherein the traffic control tower includes at least one of a photocell and a timer in communication with the controller for illuminating the street sign under low light conditions.

17. The method of claim 14, further comprising:

powering the at least one dedicated emergency response warning lamp, the at least one traffic signal lamp, and the controller with solar energy absorbed by a solar power collecting device affixed to the traffic control tower during daylight;

charging a plurality of battery cells disposed within the traffic control tower with solar energy absorbed by the solar power collecting device, the plurality of battery cells in communication with the at least one dedicated emergency response warning lamp, the at least one traffic signal lamp, and the controller; and powering the at least one dedicated emergency response warning lamp, the at least one traffic signal lamp, and the controller during low light conditions using energy stored in the plurality of battery cells.

* * * * *